United States Patent [19]

Antonellis

[11] Patent Number: 4,846,628

[45] Date of Patent: Jul. 11, 1989

[54] ROTOR ASSEMBLY FOR A TURBOMACHINE

[75] Inventor: Stephen M. Antonellis, Manchester, Conn.

[73] Assignee: United Technologies Corporation, Hartford, Conn.

[21] Appl. No.: 289,113

[22] Filed: Dec. 23, 1988

[51] Int. Cl.[4] ..... F01D 5/32

[52] U.S. Cl. ..... 416/220 R; 416/221

[58] Field of Search ..... 416/221, 220 R, 219 R

[56] References Cited

U.S. PATENT DOCUMENTS

| | | | |
|---|---|---|---|
| 2,971,744 | 2/1961 | Szydlowski | 416/221 |
| 3,045,329 | 7/1962 | Carli et al. | 29/156.8 |
| 3,057,598 | 10/1962 | Boyle et al. | 416/221 |
| 3,076,634 | 2/1963 | Boyle et al. | 416/221 |
| 3,096,074 | 7/1963 | Pratt et al. | 416/221 |
| 3,224,668 | 12/1965 | Olmsted et al. | 416/221 |
| 3,508,844 | 4/1970 | Le Blanc | 416/221 |
| 3,653,781 | 4/1972 | Cooper | 416/221 |
| 4,444,544 | 4/1984 | Rowley | 416/221 |
| 4,470,756 | 9/1984 | Rigo et al. | 416/220 R |
| 4,669,959 | 6/1987 | Kalogeros | 416/221 |
| 4,676,723 | 6/1987 | Kiger et al. | 416/221 |

FOREIGN PATENT DOCUMENTS

| | | | |
|---|---|---|---|
| 2358545 | 2/1978 | France | 416/221 |
| 2524933 | 10/1983 | France | 416/220 R |

*Primary Examiner*—Everette A. Powell, Jr.
*Attorney, Agent, or Firm*—Troxell K. Snyder

[57] ABSTRACT

A rotor assembly (34) includes a disk (36) having an axially extending, unbroken annular spigot (38). The spigot (38) supports a plurality of radially extending lugs (42) which are juxtaposed with a corresponding plurality of dogs (14) integral with an annular sideplate (12). A smooth key (54) fits within the opening (44) formed between adjacent engaged dogs and lugs (14, 42) and is retained axially by a sheet metal retainer (46) received through a slot (52) disposed in the key (54).

2 Claims, 1 Drawing Sheet

ROTOR ASSEMBLY FOR A TURBOMACHINE

FIELD OF THE INVENTION

The present invention relates to a turbomachine rotor having a sideplate secured by a bayonnet or breach lock.

BACKGROUND

Bladed turbomachine rotors wherein an annular sideplate is secured axially abutting the periphery of the disk in the vicinity of the blade root attachment are well known in the art. Typically such sideplates are secured by means of cooperating dogs and lugs extending radially from the respective sideplate and disk. During assembly, the disk and sideplate are oriented so as to allow the lugs and dogs to pass axially via circumferentially intermediate gaps, then indexed rotationally so as to juxtapose the dogs and lugs in an engaged, axially interfering position.

The engaged disk and sideplate are locked against rotation by means of at least one locking element comprising, in the prior art, a key which is inserted into one of the plurality of gaps formed intermediate adjacent engaged dogs and lugs. The key is itself held in position by a sheet metal retainer sandwiched between the engaged sideplate and disk and having an axially extending tongue portion which is bent around the key so as to trap the key axially in the formed gap. U.S. Pat. No. 4,669,959 issued to Kalogeros is illustrative of the prior art configuration.

As the antirotation function requires only one of such keys, and as it is desired to minimize the amount of weight at the disk periphery, typical engine assemblies as a rule use no more than two such keys for safely securing the sideplate and disk against relative rotation. The remaining unfilled gaps interact with the radially flowing cooling air originating adjacent the rotor axis and flowing outward past the airseal into the surrounding annular working fluid flow stream. In the prior art, the gaps in the assembled rotor and sideplate open both radially and axially, and the aerodynamic interaction between the unfilled gaps and cooling air stream results in a small but significant aerodynamic heating and overall efficiency loss for the rotor and hence the entire gas turbine engine.

The antirotation keys of the prior art also require significant attention during the manufacturing thereof so as to insure a secure fit within the formed gap. As the gap opens both radially and axially, the key must match closely with the remaining disk and sideplate structure so as to avoid becoming dislodged during engine operation.

What is required is a sideplate, disk, and key assembly which reduces the aerodynamic losses imposed by the unfilled gaps of the prior art.

SUMMARY OF THE INVENTION

The present invention provides a sideplate and disk rotor assembly having reduced aerodynamic windage loss and hence reduced gas temperature at the disk periphery. According to the present invention, an annular sideplate is releasably secured to a rotatable disk member by an annular bayonnet lock arrangement. The bayonnet lock includes a plurality of radially inward and outward extending dog and lug members which are engaged axially by rotating the sideplate relative to the disk into a locked position.

Unlike prior art sideplate and disk bayonnet arrangements, the present invention provides an unbroken annular spigot for supporting the radially outwardly extending disk lug members. The unbroken spigot surface presents a smooth annular surface to radially flowing cooling air at the disk face, diverting the air axially past the bayonnet lock and sideplate, thus avoiding the high windage losses of the prior art.

The rotor assembly according to the present invention also provides a locking means for preventing relative rotation of the secured sideplate and disk. The locking means is particularly adapted to the low windage design of the bayonnet lock, including a sheet metal retainer having a tongue portion which is received in a corresponding slot disposed in a key member shaped to be received within an axially extending gap formed between adjacent engaged dog and lug members.

Both these and other features and advantages of the rotor assembly according to the present invention will be apparent to those skilled in the art upon review of the following specification and the appended claims and drawing figures.

DETAILED DESCRIPTION OF THE PREFERRED EMBODIMENT

Figure 1:
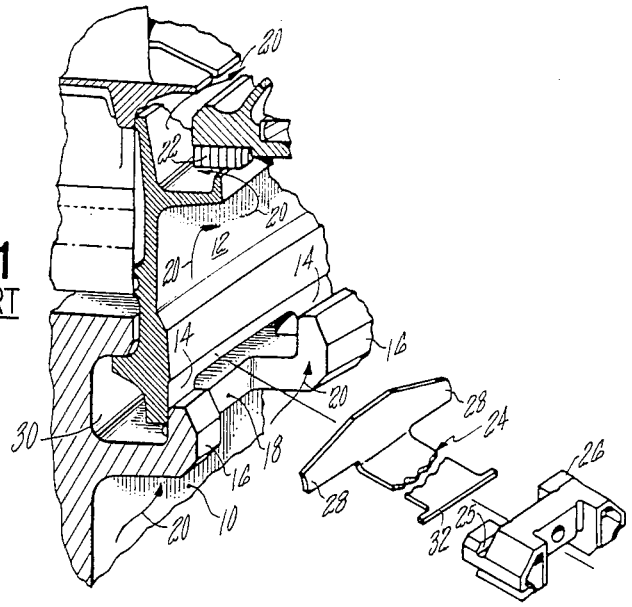
FIG. 1 PRIOR ART
FIG. 1 shows a view of the periphery of a disk engaged with a sideplate and a key member according to the prior art.

FIG. 1 shows a portion of the periphery of a disk 10 having a sideplate 12 abutting the periphery thereof. The sideplate 12 includes a plurality of radially inwardly extending dogs 14 which, as described in the Background section above, are engaged with a corresponding plurality of lugs 16 extending radially outward as shown in FIG. 1. The sideplate 12 is thus retained in an abutting relationship with the periphery of the disk 10, and forms a plurality of gaps 18 intermediate adjacent engaged lugs and dogs.

As also discussed hereinabove, cooling air 20 flows radially outward over the disk 10, ultimately exiting at the radially outer portion of the sideplate 20 at the rotating seal formed by the rotating knife edge 21 and the nonrotating honeycomb 22. As also noted above, the aerodynamic losses associated with the passage of the cooling air 20 through the radius of the rotating gaps 18 causes not only heating of the cooling air 20, but also imparts a viscous drag to the rotating assembly.

FIG. 1 also shows a view of the anti-lock key members 24, 26 which comprise a key 26 adapted to be received within at least one of the gaps 18, and the sheet metal retainer 24 having circumferentially extending arms 28 which fit into the grooves 25 in the key 26 and span the gap 18 between the sideplate dogs 14. The axially extending tongue portion 32 of the retainer 24 is then bent over the key 26 as is well disclosed in U.S. Pat. No. 4,669,959 described hereinabove. The retainer 24 of the prior art provides both radial and axial retention to the key 26.

Figure 2:
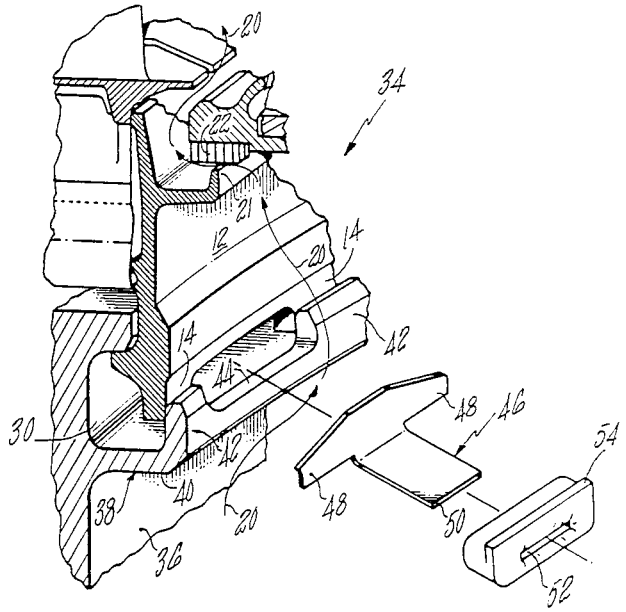
FIG. 2 shows an engaged disk and sideplate along with an antirotation key according to the present invention.

FIG. 2 shows the rotor assembly 34 according to the present invention having sideplate 12, air seal elements 21, 22, and disk 36. The disk 36 according to the present invention includes an axially extending, annular spigot 38 which provides an unbroken, radially inward facing surface 40 for deflecting the cooling air 20 axially as the air 20 flows generally radially outward over the cooperating dogs 14 and lugs 42. Unlike the prior art in which a plurality of radially inward opening gaps 18 are formed, the rotor assembly 34 according to the present invention provides an unbroken, radially inward facing surface 40 with the openings 44 formed between the engaged lug and dog members 42, 14 opening essentially in the axial direction only.

The anti-rotation lock members according to the present invention comprise a sheet metal retainer 46 having arm portions 48 located within the annular volume 30 and spanning the opening 44 between adjacent sideplate dogs 14 as in the prior art, and a tongue portion 50 which is received within a slot 52 which is received within a key member 54. The locking elements 46, 54 function by preventing rotation of the sideplate 12 relative to the disk 36 by interposing the key member 54 circumferentially between adjacent engaged dogs and lugs 14, 42. The tongue portion 50 of the sheet metal retainer 46 is received within the slot 52 and projects axially therefrom following positioning of the key member 54 in the opening 44. The sheet metal tongue 50 is then bent radially to secure the key 54.

It will be appreciated by those skilled in the art that the unbroken radially inward facing spigot surface 40 deflects the radial cooling air flow 20 around the sideplate and disk engaging members 14, 42 thereby avoiding the aerodynamic interaction caused by the radially inward opening gap 18 of the prior art. Further, the key member 54 which provides anti-rotation between the sideplate 12 and disk 36 is confined radially and circumferentially by the engaged sideplate and disk 12, 36, thereby requiring only axial retention by the sheet metal retainer 46. The arrangement according to the present invention further reduces the need to carefully form the key member 54 so as to closely fit within the surrounding disk and sideplate structure, thereby reducing overall fabrication costs.

One final advantage of the rotor assembly 34 according to the present invention is the reduced thickness and hence weight of the disk portion of the sideplate retaining structure 38, 42. The unbroken axially extending annular spigot 38 provides a stiff structure for supporting the radially outward extending lugs 42, thereby reducing the overall thickness and weight of the disk components.

It will be apparent to those skilled in the art that the rotor assembly according to the present invention may equivalently be embodied by a variety of different configurations, with the foregoing example being only one thereof. Hence the example is disclosed only as being illustrative of the preferred embodiment of the present invention and should not be taken as limiting the scope thereof except as required by the claims recited hereinbelow.

I claim:

1. A rotor assembly for a turbomachine, comprising a disk having a plurality of blades secured at the periphery thereof, an annular sideplate radially coincident with the disk periphery, means for releasably securing the sideplate to the disk in an abutting relationship, including an axially extending annular spigot integral with the disk, said spigot having an unbroken, radially inward facing cylindrical surface and a plurality of radially outwardly extending lugs, a plurality of radially inward extending dogs integral with the sideplate, the dogs sized to pass axially intermediate the lug members during assembly of the disk and sideplate, and to interfere axially with the disk lugs when the sideplate and disks are rotated to juxtapose the dogs and lugs, and means, secured circumferentially intermediate adjacent juxtaposed dogs and lugs, for locking the sideplate and disk against relative rotational movement.

2. The rotor assembly as recited in claim 1 wherein the locking means comprises a sheet metal retainer having two circumferentially extending arms and an axially extending tongue, the arms overlapping circumferentially adjacent juxtaposed dogs and lugs, and a key member sized to fit within an axially extending gap formed between the adjacent juxtaposed dogs and lugs, the key member further including a slot disposed therethrough for receiving the axially extending sheet metal tongue.

* * * * *